US005095839A

United States Patent [19]

Peterson

[11] Patent Number: 5,095,839

[45] Date of Patent: Mar. 17, 1992

[54] STABILIZER FOR BOATS AND THE LIKE

[75] Inventor: Ralph Peterson, Long Beach, Calif.

[73] Assignee: Scott G. Nettleman, Santa Barbara, Calif.

[21] Appl. No.: 594,114

[22] Filed: Oct. 9, 1990

[51] Int. Cl.[5] ..... B63B 39/00

[52] U.S. Cl. ..... 114/122; 114/126

[58] Field of Search ..... 114/121, 122, 126, 311, 114/244

[56] References Cited

U.S. PATENT DOCUMENTS

| | | | |
|---|---|---|---|
| 1,299,186 | 4/1919 | Imaizumi . | |
| 2,561,539 | 1/1949 | Seward . | |
| 3,029,767 | 4/1962 | Donnan | 1.4/121 |
| 3,179,078 | 12/1962 | Popkin . | |
| 3,589,324 | 6/1971 | Hoffman | 1.4/122 |
| 4,061,102 | 12/1977 | Bissett | 1.4/122 |

OTHER PUBLICATIONS

Roll-Control (U.S. #3,589,324).

Roll-EEZ.

Rock-Stopper.

*Primary Examiner*—Jesus D. Sotelo

*Assistant Examiner*—Stephen P. Avila

[57] ABSTRACT

An apparatus for stabilizing a vessel to drastically reduce the rolling and/or pitching of floating vessels, platforms, or the like. At least one stabilizer is suspended by a bridle secured from a vessel so as to be submerged in the water. The stabilizer is formed having a pair of hingedly connected wing members, so-called with regard to their shape which is formed by a sequence of longitudinal sections associated by dimension and angle to provide a differential convexity over their breadth. This wing shape actuates rapid configural changes in the stabilizer so that the wing members assume an open span resisting bridle tension, or a folded swiftly sinking phase when the bridle is not tensioned. The wing shape is adjustable in camber and aspect ratio to retain optimal efficiency at any scale.

8 Claims, 2 Drawing Sheets

STABILIZER FOR BOATS AND THE LIKE

BACKGROUND OF THE INVENTION

1. Field of the Invention

The present invention relates generally to boat or ship stabilizing devices and more particular to a stabilizing apparatus that is adapted to operated when at least one or more stabilizers are suspended over the sides or ends of a vessel so as to dampen the rolling motion of the vessel while the vessel is at anchor, moored, riding at sea-anchor, docked or drifting.

2. Description of the Prior Art

As is well known in the art, various problems and difficulties are encountered in providing suitable means for reducing the roll and/or pitch of floating vessels, such as boats, ships and the like.

Many types of stabilizers have been tried and suggested. However, some of these devices have various design limitations that have proven to operate poorly and inefficiently under working conditions. Moreover, some types of stabilizers are complicated to operate and expensive to maintain. As examples of some known boat stabilizers, one may refer to any of the following United States Patents.

There is disclosed in U.S. Pat. No. 1,299,186 to T. Imaizumi a ship stabilizer which includes a plurality of upright cups suspended from opposite sides of a boat.

U.S. Pat. No. 3,179,078 to J. R. Popkin is directed to a hydrofoil stabilizer for sailboats.

U.S. Pat. No. 3,260,232 to D. W. Douglas discloses a stabilizer suspended from a boat by means of a pair of cables positioned forwardly and rearwardly of the center of gravity of such stabilizer whereby the pitch thereof may be controlled.

U.S. Pat. No. 2,561,539 to Seaward is directed to a marine stabilizer which includes a triangularly shaped fin, which is weighted at its forward extremity by means of a weight. The fin is attached to a pole projecting transversely from a boat by means of a cable. When the boat rolls to one side the weight will cause the fin to plunge downwardly nose first and when the boat rolls to the opposite side, raising the fin, the cable will pull the nose of such fin upwardly causing such fin to assume a horizontal orientation to resist rolling of the boat.

One may also refer to U.S. Pat. No. 3,589,324 which is known in the industry as Roll-Control and consist of a rectangular frame structure covered by a sheet material that is cut in the center thereof to define a flap valve.

Other known stabilzing devices include the ROLL-EEZ which is a rectangular frame member having a plurality of movable vanes mounted therein and the Rocker-Stopper which is a cone-shaped device formed from a lightweight plastic.

Many seasons of cruising have proven the general disappointment with the available devices meant to dampen the rolling motion of vessels on the water, and provided the impetus to design a more efficient device. The problems with the available devices are largely in two areas. The first involves the use of too much energy in the actuation of their valve-flap-door-gait system, limiting their vertical working displacement and causing a curve of increasing efficiency very slowly through time in a resistance or drop mode. That is to say that the prevailing designs offer maximum resistance-to-roll forces for a very brief period of the rolling cycle, and the resistance is further compromised by frictional, buoyant, and actual operational forces by virtue of a poor design concept. Secondly, theses devices provide a flat surface in the resistance phase, and have a tendency in more than above moderate sea conditions to slide horizontally, providing horizontal force components to hinder the vertical water-pressure-based operations.

All devices that reduce rolling use the rocking motion of the vessel to actuate the device. When fastened to the side of a vessel or cantilevered as far outboard as convenient, a roll toward the side from which the device is hanging will lower it in the water column, and a roll back to the other side will raise it in the water column. Thus, the working phase of the cycle occurs with lifting where the shape of the device offers hydrodynamic resistance against the water dragging above it. Conversely, in the downward or dropping portion of the cycle the mass and shape should allow gravity to pull the device to the bottom of a working cycle with minimal resistance. A device which has insufficient mass, or uses excessive working forces to change surface areas, or offers too much surface area in the free-fall stage or too little surface area in the resistance stage, will provide a fraction of its potential dampening action. In addition, a device must change surface areas within a minimum of the vertical displacement to do actual work, or be effective in the moderate rolling that occurs most frequently in more sheltered anchorages.

OBJECTS AND ADVANTAGES OF THE INVENTION

The present invention comprises a novel arrangement for a stabilizing apparatus to drastically reduce the rolling and or pitching of any floating vessel or platform. The stabilizer is defined by a combination of elongated juxtaposed surface forms, which will hereinafter be referred to as wing members. One embodiment of the stabilizer is one pair of wing members hingedly connected together near their tail ends so that the wing members can rotate from a substantially vertical folded configuration to a substantially horizontal open span, much like a butterfly flapping its wings. More like a puppet butterfly, the stabilizer is suspended in the water column by a bridle comprising pairs of tethers fastened to each wing member, and connected together above the stabilizer to a single tether hung from an outboard strut system or fastened onboard the vessel or platform. The flapping motion occurs with vertical displacement in the water column, and is actuated by the curvilinear aspect of the wing member, which unliko a butterfly wing has a faceted foil shape in cross-section. This wing shape is formed by a sequence of bent regions so that a specific convexity is imparted over the breadth of each wing member, being correspondingly concave underneath or to the outside of each wing member. This convexity is greatest approaching the outer longitudinal edges of each wing member.

Accordingly, when the bridle is slackened gravity accelerates the stabilizer downward and greater hydrodynamic resistance at the outer regions of increased convexity causes the stabilizer to collapse—pushing the larger inner surface areas of the wing members into angles of negligible hydrodynamic resistance, while lingering sections of resistant angle at the outer edges accelerates complete closure to a configuration of least horizontal surface area to mass, and the stabilizer quickly plunges to the bottom of the entire vertical displacement provided at the bridle attachment site. When the bridle is tensioned the diverging regions of convexity cause high fluid pressurization on the insides of the wing members and low pressure regions on the outsides pulling apart the wings and popping the stabilizer into a configuration of maximum surface area, dragging the fluid up underneath the wing members and countering the tension of the bridle. Collision of sections beneath the hinged connection cause an abrupt seizure of rotation at an angle corresponding to the angles of the bottom sections, this seizure causes a dynamic braking force in addition to the static dragging forces resisting lift in the water column. The degree of convexity, or camber, of the wing member relates directly to the degree of acceleration between configurations, while inversely affecting the overall maximum and minimum surface areas in the completely open or completely folded configurations. The optimal camber of a wing member is a function of the dimensions of the wing member, which is a function of the power requirements, or optimal length and breadth aspect ratios—all relating directly to the specific characteristics and requirements of different vessels or platforms or categories thereof. This flexibility provided by changes in the section surface areas, their intervening angles, and or the density of different section arrays results in unprecedented efficiency of the apparatus at any scale of dimensional expansion or diminution.

Thus, the present invention has for an important object a provision wherein the shape of the wing members induce differential pressurizations about the wing form accelerating configural shifts in surface area from a minimum of resistance in sinking to a maximum drag at lifting with great efficiency translatable to any dimensional requirements.

Still another object of the invention is a dynamic instantaneous braking force complementing the static dragging forces.

An additional object of the invention is an apparatus of simple design, not encumbered by elastic parts or any superfluity that hinders efficiency, reliability, or longevity working at harsh loads in a marine environment.

A further object of the invention is to provide a stabilizer that is not unnecessarily heavy or massive, and is easily handled and compact for stowage.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements of modes of operation that are properly within the scope of the appended claims.

BRIEF DESCRIPTION OF THE DRAWINGS

Novel features and advantages of the present invention, in addition to those mentioned above, will become apparent to those skilled in the art from reading the following detailed description in conjunction with the accompanying drawings wherein.

DESCRIPTION OF THE PREFERRED EMBODIMENT

Figure 1:
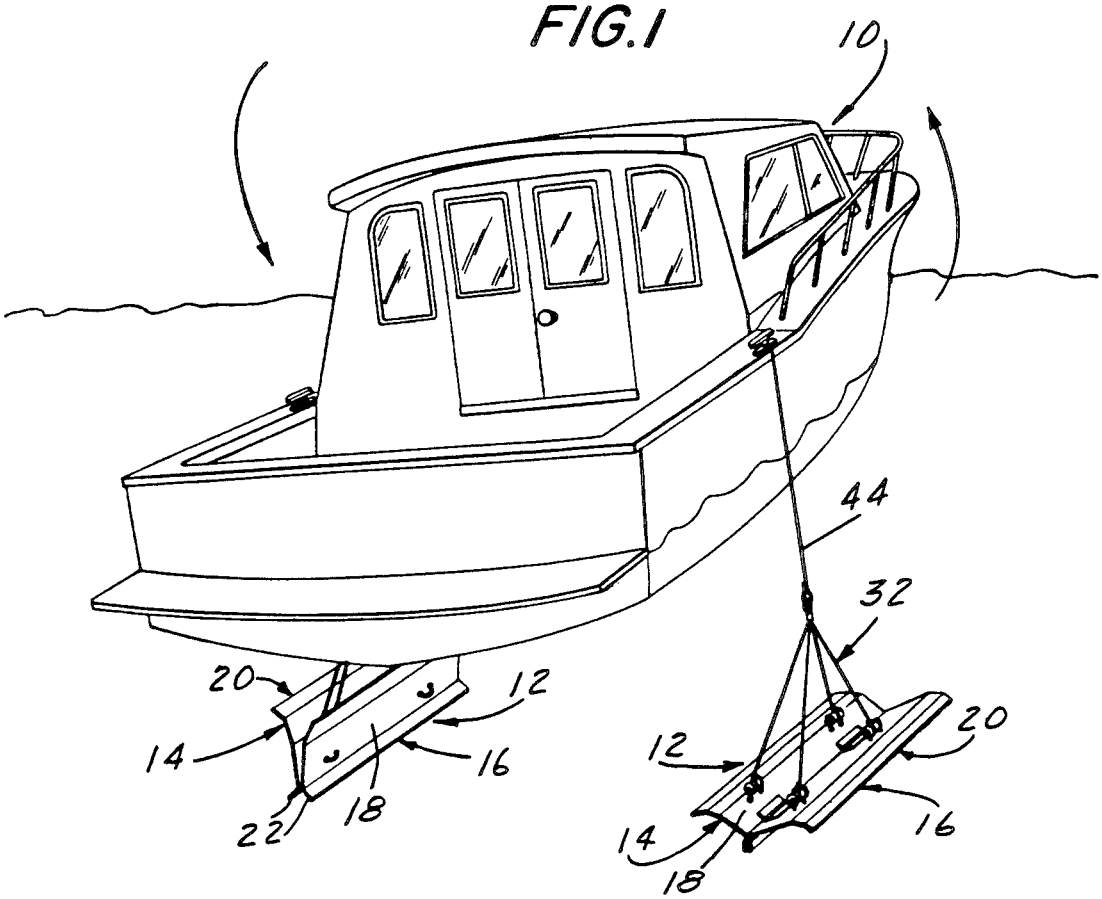
FIG. 1 is a pictorial view of a boat floating with a pair of stabilizers attached to each side of the vessel, wherein the stabilizer on the port side is closed and moving in a downward direction, and the stabilizer on the starboard side is in an open position and raised upwardly.

Referring more particularly to FIG. 1, there is shown a boat, generally indicated at 10, and hereinafter referred to as a vessel, that is floating in water. Attached to the port and starboard sides of vessel 10 is a stabilizer, designated at 12, which defines the present invention. However, it should be noted at this time that various methods can be employed to attach and hang the stabilizers over the side of a vessel. The method as illustrated in FIG. 1 is called a gunwale attachment. Other methods can be used such as the pole and strut arrangements that extend outwardly over the sides of the vessel to increase the moment arm for greater torque to reduce roll. Further, it should be understood that the present invention is adapted not only to control the roll of a vessel but also to reduce the pitch by mounting the stabilizer, bow and stern.

The invention is effective when one stabilizer is positioned to one side of a vessel, and more so when two stabilizers are employed, that is, one stabilizer is positioned on the opposite side of the vessel from the other, where at any one time a stabilizer is in a roll resistant mode.

In order to effectively provide for proper opening and closing thereof, stabilizer 12 comprises a pair of juxtaposed blades or wing members 14 and 16. Each wing is made identical in structure, and therefore the detailed description of one wing would be identical for the other. Thus, the following description will suffice for both wing members 14 and 16.

Figure 3:
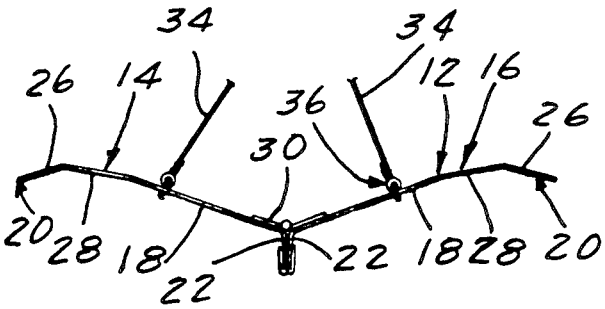
FIG. 3 is an end view of the stabilizer in an open arrangement.
Figure 4:
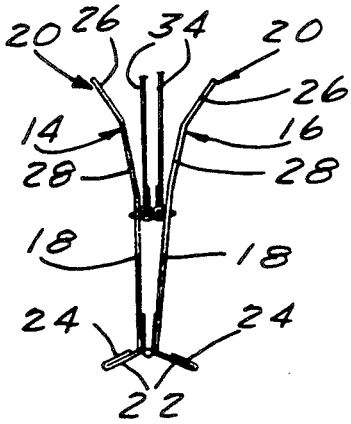
FIG. 4 is an end view thereof wherein the stabilizer is in a closed and folded arrangement.

The wings are formed having an elongated, substantially flat midsection 18, an outer longitudinal flared edge 20, and an inner longitudinal edge 21 that is defined by a downwardly bent flange member 22. Flange 22 defines a means to limit the open-winged position, as more clearly shown in FIG. 2. The flange is also shown as having a folded member 24 which provides strength to the flange member when it engages the oppositely disposed flange member of the adjacent wing, as illustrated in FIG. 3. The flared edge 20 is formed having first and second outwardly and downwardly bent contiguous sections 26 and 28. Blades 14 and 16 are hingedly connected together by means of a hinge or hinges 30 that are secured along the length of inner edge 21. It is contemplated that any suitable hinge means can be readily employed to provide the necessary flapping action between the two wing members.

Figure 2:
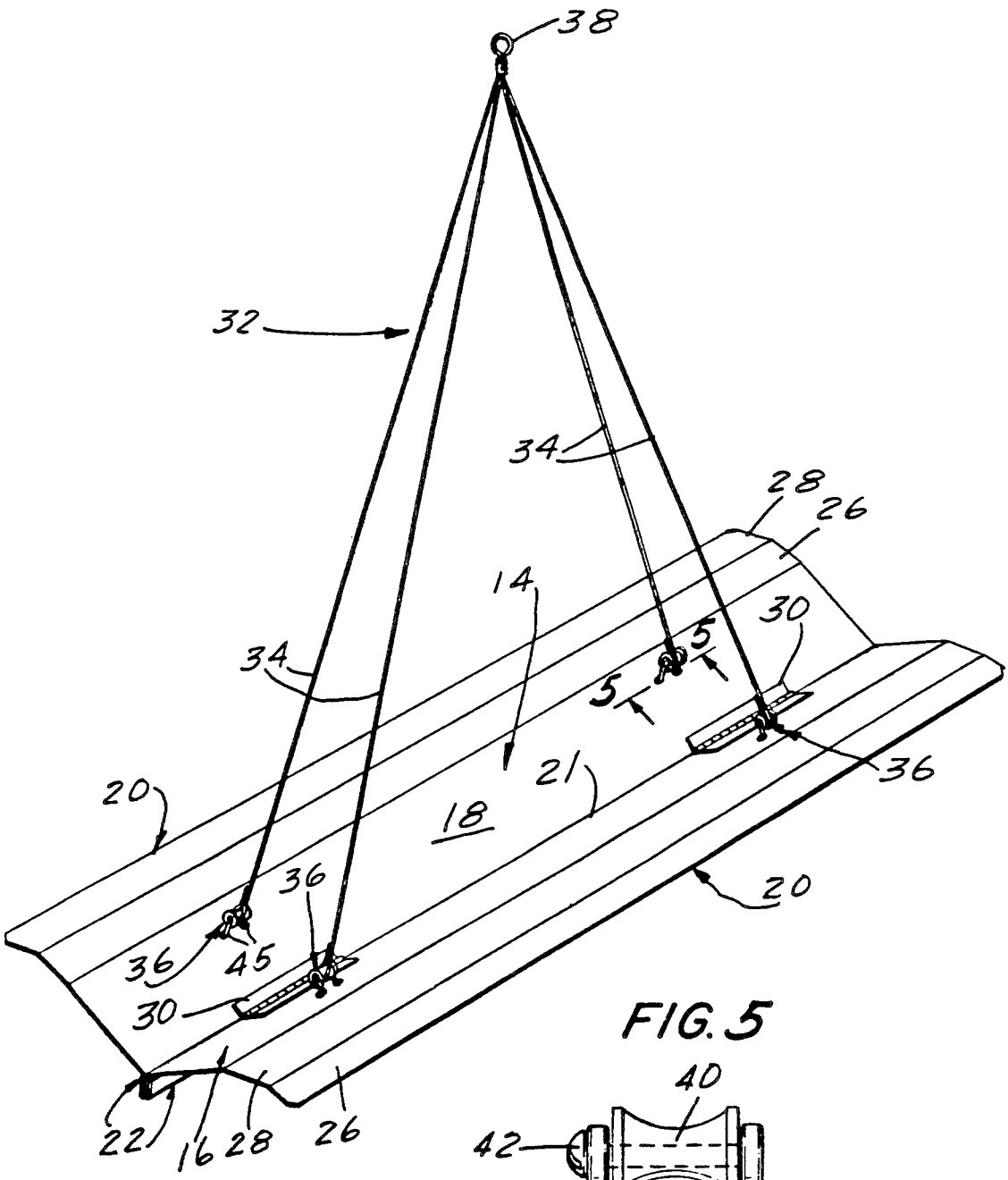
FIG. 2 is an enlarged perspective view of the stabilizer in an open position and a bridle attached to each of the blade members.
Figure 5:
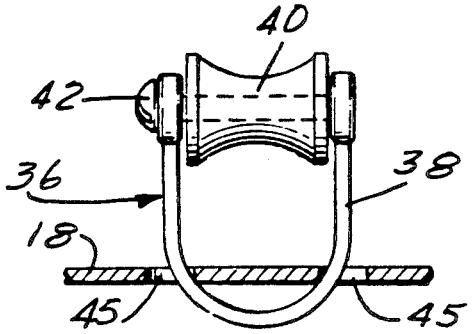
FIG. 5 is an enlarged cross-sectional view taken substantially along line 5—5 of FIG. 2 showing an attaching device for the bridle.

A bridle means, indicated generally at 32, is illustrated in FIGS. 1 and 2, wherein the bridle means comprises four control tie lines 34. Each line 34 is connected at its free end to one of the wing members by a connector means 36, the opposite ends thereof being secured together at a predetermined length with an eye hook 38. Various suitable connector means can be employed. However, the preferred arrangement is shown in FIG. 5, which comprises a U-shaped shackle 38 and a rotatable spool member 40 that is removably attached thereto by screw pin 42. The free end of each line is secured about spool member 40. A tether line 44 is removably attached to eye hook 38 so as to allow the stabilizer 12 to freely hang from the vessel, as seen in FIG. 1. Shackle member 36 is attached to the wing members by being received in a pair of holes 45 formed in wing members 14 and 16.

It may be thus seen that the objects of the present invention set forth herein, as well as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A stabilizing apparatus to reduce the roll and/or pitch of a floating vessel or platform comprising:

a pair of wing members hingedly connected together along the inner longitudinal edges of the juxtaposed wing members, wherein each of said wing members is a surface form including three or more contiguous sections having intervening angular displacements and substantially longitudinal adjoining borders;

means for hinging said wing members together whereby said wing members can rotate between a substantially horizontal open position to an upright folded position, these positions being activated by the rolling motion of the vessel;

bridle means secured to said wing members; and, means for securing said bridle means to said wing members.

2. A stabilizer apparatus as recited in claim 1, wherein said contiguous sections combine to form a faceted arc that is substantially convex across the breadth of the inside or superior surface of each of said wing members.

3. A stabilizer apparatus as recited in claim 1, wherein said intervening angular displacements are normally obtuse interior angles formed across the breadth of the outside or inferior surface of each of said wing members.

4. A stabilizer apparatus as recited in claim 1, wherein said contiguous sections normally include broad and gently sloping areas outward and upward from a very narrow stem section, and a more numerous array of outwardly and downwardly bent narrow areas along the outer margins of said wing members.

5. A stabilizer as recited in claim 1, wherein the shapes of each of said juxtaposed wing members are normally mirror images of each other, to congruously rotate about said hinged connection.

6. A stabilizer apparatus as recited in claim 1, wherein contact between said contiguous sections juxtaposed either proximally or distally to said hinged connection abruptly arrests rotation of said wing members in either a configuration of maximum span or a configuration of minimum span.

7. A stabilizer apparatus as recited in claim 1, wherein tethers of said bridle means can close together without colliding, by longitudinally staggering corresponding attachment sites of said securing means onto nonaligned positions on said wing members.

8. A stabilizer apparatus as recited in claim 1, wherein said securing means comprises a shackle and pin arrangement loosely articulated into each of said wing members, and a tether bushing bearing on said pin, whereby this removably attached combination of interbearing components is universally pivotal.

* * * * *